United States Patent [19]

Yamamoto

[11] Patent Number: 4,997,132

[45] **Date of Patent: * Mar. 5, 1991**

[54] FUEL INJECTOR

[75] Inventor: Yoshihisa Yamamoto, Kariya, Japan

[73] Assignee: Nippondenso Co., Ltd., Aichi, Japan

[ * ] Notice: The portion of the term of this patent subsequent to Oct. 11, 2005 has been disclaimed.

[21] Appl. No.: 414,746

[22] Filed: Sep. 27, 1989

Related U.S. Application Data

[63] Continuation of Ser. No. 119,379, Nov. 12, 1987, abandoned.

[30] Foreign Application Priority Data

Nov. 11, 1986 [JP] Japan ..... 61-268128

[51] Int. Cl.[5] ..... F02M 47/00

[52] U.S. Cl. ..... 239/533.8

[58] Field of Search ..... 239/533.3–533.9, 239/88, 90, 96, 584; 137/189.5

[56] References Cited

U.S. PATENT DOCUMENTS

| | | | |
|---|---|---|---|
| 2,536,542 | 1/1951 | Evans et al. | 239/533.8 X |
| 3,997,117 | 12/1976 | Kohler et al. | 239/533.8 |
| 4,165,724 | 8/1979 | Yamamoto et al. | 123/139 AJ |
| 4,167,168 | 9/1979 | Yamamoto | 123/139 AJ |
| 4,379,524 | 4/1983 | Andrews | 239/533.8 |
| 4,402,456 | 9/1983 | Schneider | 239/90 |
| 4,427,152 | 1/1984 | Sisson et al. | 239/90 |
| 4,528,951 | 7/1985 | Yamada | 239/533.3 X |
| 4,566,635 | 1/1986 | Trachte | 239/533.3 X |
| 4,684,067 | 8/1987 | Cotter et al. | 239/533.8 X |
| 4,776,518 | 10/1988 | Yamamoto | 239/533.4 |

FOREIGN PATENT DOCUMENTS

| | | | |
|---|---|---|---|
| 2422736 | 12/1974 | Fed. Rep. of Germany . | |
| 59-48302 | 11/1984 | Japan . | |
| 60-60032 | 12/1985 | Japan . | |
| 672365 | 7/1978 | U.S.S.R. | 239/533.8 |
| 2030219 | 4/1980 | United Kingdom | 239/533.8 |

OTHER PUBLICATIONS

Society of Automotive Engineers—UFIS—A New Diesel Injection System—J. A. Kimberley & R. A. DiDomenico—770084.

*Primary Examiner*—Andres Kashnikow
*Assistant Examiner*—Kevin P. Weldon
*Attorney, Agent, or Firm*—Cushman, Darby & Cushman

[57] ABSTRACT

A fuel injector for injecting fuel into a combustion chamber of internal combustion engine with an injection flow rate that changes during an injection cycle. It provides a gradual increase in fuel injection rate near the beginning of the cycle and a substantially instantaneous shut off of fuel injection at the end of the cycle. The valve includes a nozzle body with a fuel inlet and a nozzle portion which has an injection port therein, a first fuel passage for communicating the injection port with the fuel inlet, a first slidable needle valve element, a first spring for urging the first needle valve element to close the first needle valve element, a second fuel passage for communicating a back pressure chamber with the fuel inlet, an ON-OFF valve for opening and closing the second fuel passage and throttling the effective area thereof when the second fuel passage is open thereby controlling the pressure of the first back pressure chamber means.

8 Claims, 2 Drawing Sheets

FUEL INJECTOR

BACKGROUND OF THE INVENTION

This is a continuation of application Ser. No. 119,379, filed Nov. 12, 1987, which was abandoned upon the filing hereof.

1. Field of the Invention

The present invention relates in general to fuel injection valves for an internal-combustion engine. More specifically, the invention provides a fuel injector having a particulary advantageous fuel flow characteristic, namely the fuel injection rate slowly increases early in the injection cycle and instantaneously reduces at the end of the injection cycle.

2. Description of the Prior Art

Fuel injection valves are known wherein the valve opens when fuel pressure to the valve which is applied to a pressure receiving area of a needle valve element rises above the preset bias of a spring which forces the valve closed. The valve closes when the fuel pressure becomes lower than the preset spring bias.

It has been found to be desireable, because of the requirements to produce cleaner vehicle exhaust and to save on fuel consumption, to control the rate of fuel injection in a certain manner. More specifically, it has been found to be advantageous to slowly increase the rate of fuel injection at the beginning of a fuel injection cycle and rapidly decrease the rate of fuel injection at the end of the fuel injection cycle. Furthermore, it is desirable to perform a pilot fuel injection at a low engine speed.

Therefore, as shown in, e.g., Japanese Patent Examined Publication No. 59-43802, there has been provided an apparatus in which a back pressure chamber associated with a needle valve element is provided. The motion of the needle valve element is controlled by hydraulic pressure in the back pressure chamber. However, in such an arrangement, a hydraulic pressure source is necessary. Furthermore, only a slow increase in fuel injection rate can be obtained.

According to another known fuel injector arrangement, only an instantaneous decrease in fuel injection rate at end of a fuel injection cycle ca be obtained. It is not possible to obtain the slow increase that is desireable at the beginning of a fuel injection cycle.

Still another known injector arrangement purports to provide a slow increase in fuel injection rate early in the injection cycle with an instantaneous reduction in fuel injection rate at the end of the injection cycle. However, it does not adequately perform. Thus far, it has seemed to be impossible to provide both of the foregoing desireable changes in fuel injection rate and a pilot fuel injection by the same valve.

SUMMARY OF THE INVENTION

It is an object of the present invention to provide a fuel injector arrangement having a simple construction which can slowly increase the rate of fuel injection at the beginning of a fuel injection cycle and then substantially instantaneously decrease the fuel injection rate at the end of the injection cycle, while also being able to perform a pilot fuel injection in either the whole rotational speed range of the engine or at least in a predetermined "special" rotational speed range.

DETAILED DESCRIPTION OF THE PREFERRED EMBODIMENTS

Figure 1:
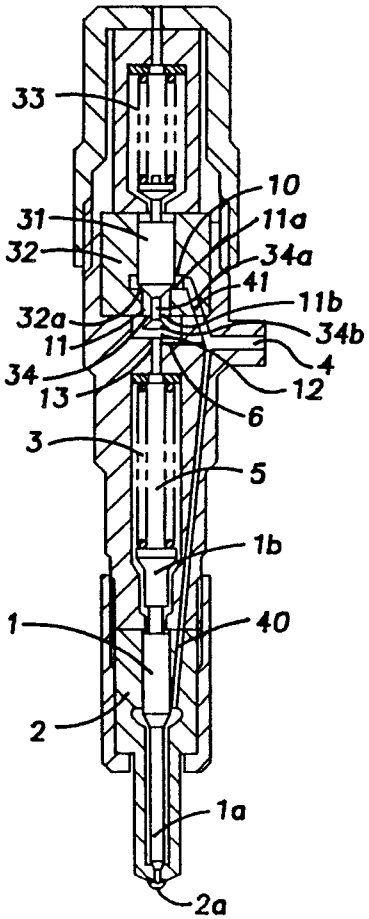
FIG. 1 shows a vertical sectional view of a fuel injector according to a first embodiment of the invention.

A first embodiment of the present invention will be described with reference to FIGS. 1 to 3. FIG. 1 is a sectional view of the first embodiment. A nozzle needle valve 1 is arranged slidable but oil-tight in a nozzle body 2 so that the nozzle body and the nozzle needle valve 1 together constitute a fuel injection valve.

The nozzle needle valve 1 is reciprocated in the nozzle body 2 by the pressure of fuel pumped from a fuel injection pump (not shown). In accordance with these reciprocations one end 1*a* of nozzle needle valve 1 opens and closes an injection port 2*a* of the nozzle body 2 to inject the fuel into the combustion chamber of an internal combustion engine (not shown).

At the other end 1*b* of the nozzle needle valve 1, there is formed a back pressure chamber 5 for maintaining a pressure for closing nozzle needle valve 1. Within back pressure chamber 5, there is disposed a spring 3 which abuts the face of the other end 1*b* of the nozzle needle valve 1 to bias the valve closed. In other words, the nozzle needle valve 1 is loaded with a set load by the spring 3.

A fuel passage 4 communicates with a fuel injection pump (not shown) so that the fuel under pressure is pumped therethrough into the nozzle body 2. The fuel passage 4 communicates with an introduction passage 40 opened to the face of end 1*a* of the nozzle needle valve 1 and with the back pressure chamber 5 via a passage 41, an annular groove 10, a passage 11, a fuel chamber 12 and a passage 13 sequentially in the recited order. In other words, the passage 41, the annular groove 10, the passage 11, the fuel chamber 12 and the passage 13 together constitute a communication passage. This communication passage is opened or closed by a control valve 30 further described below.

Fuel passage 4 communicates with the passage 13 and the back pressure chamber 5 via a throttle passage 6 which by-passes the control valve 30. Control valve 30 includes a needle valve element 31, a valve member 32 and a spring 33. Passage 41 is formed in valve member 32 to annular groove 10 and the passage 11. Between the passage 11 and the annular groove 10, there is interposed the needle valve element 31 which is made slidable up and down, as viewed in FIG. 1, but oil-tight to open or close the passage 11 and the annular groove 10. Needle valve element 31 is biased downward in FIG. 1 by the spring 33 so that it blocks communication between the passage 11 and the annular groove 10 when its leading end portion is seated upon the seat portion 32*a* of the valve member 32. The opening pressure of the control valve 30 is set at a level slightly higher than that of the nozzle valve.

The needle valve element 31 has its leading end portion integrated with an extension 34, which acts as a throttle. Extension 34 includes a stem portion 34*a* and a diverging portion 34*b* diverging gradually to have a larger diameter toward its leading end. The maximum diameter of the diverging portion 34*b* is made smaller than the diameter of the passage 11.

The diverging portion 34*b* is provided to throttle the effect area of the passage 11. It begins to throttle when the needle valve element 31 moves upward, as viewed in FIG. 1, to a predetermined stroke. This relation will be explained with reference to FIG. 2. FIG. 2 presents a characteristic curve showing the relation between the lift of the needle valve element 31 and the effective area.

Figure 2:
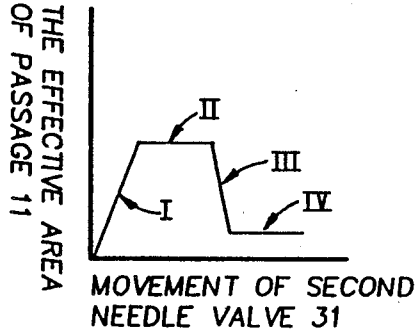
FIG. 2 shows the effective area of the passage 11 throttled by the extension 34.

When the needle valve element 31, seated on the seat portion 32*a*, moves upward, as viewed in FIG. 1, away from seat portion 32*a*, the effective area of the passage 11 at an entrance 11*a* gradually increases (as indicated by curve I of FIG. 2) until it arrives at a constant value (as indicated by curve II of FIG. 2). If the needle valve element 31 moves far upward, then the diverging portion 34*b* gradually throttles the effective area of the exit 11*b* of the passage 11 (as indicated by curve III of FIG. 2) until the effective area reaches a constant value (as indicated by curve IV of FIG. 2).

The operation of this embodiment will be described with reference to FIGS. 1 and 3. FIG. 3 depicts the operations of individual portions of the fuel injection valve shown in FIG. 1 as a function of time. In the state shown in FIG. 1, the pressurized fuel discharged from the fuel injection pump (not shown) is pumped into the fuel passage 4. After this, the fuel branches in two directions: one branch being introduced via the introduction passage 40 to the face of the one end 1*a* of the nozzle needle valve 1; and the other being introduced via the passage 41 and the annular groove 10 to the control valve 30.

When the pressure of the fuel rises to the opening pressure (which is determined by the spring and the pressure receiving area of the nozzle needle valve 1) of the nozzle valve (indicated by A in FIG. 3), the nozzle needle valve 1 is lifted against the biasing force of the spring 3 so that the nozzle valve is opened to start the fuel injection.

Figure 3:
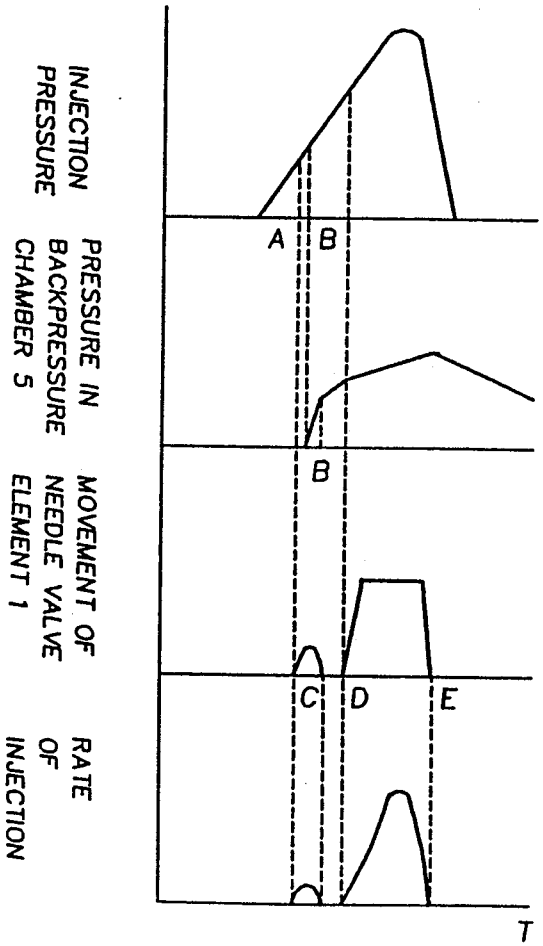
FIG. 3 shows time charts of the respective characteristics of the valve shown in FIG. 1.

If the pressure is increased by the pumped fuel, immediately after the nozzle valve is opened, so that the opening pressure (which is determined by the set load of the spring 33 and the pressure receiving area of the needle valve 31) of the control valve 30 increases the needle valve element 31 rises against the spring 33 so that the control valve 30 is opened (as indicated at B in FIG. 3). As a result, the fuel pumped from the fuel passage 4 partially flows via the passage 11, the fuel chamber 12 and the passage 13 into the back pressure chamber 5.

The effective area of the passage 11 accompanying the opening operation of the control valve 30 is as shown in FIG. 2. As a result, at the beginning (when the lift of the nozzle needle valve element 31 is small) of the opening operation of the control valve 30, much fuel flows into the back pressure chamber 5 to abruptly boost the pressure in the back pressure chamber 5. If, after this, the needle valve element 31 further rises, the effective area of the passage 11 is throttled to a smaller value by the diverging portion 34*b* so that the inflow of the fuel decreases to cause a gentle pressure rise in the back pressure chamber (indicated by B' in FIG. 3).

On the other hand, the nozzle needle valve 1 receives the force, which is determined by the pressure of the back pressure chamber 5 and the sectional area of the guide portion of the nozzle needle valve 1, in the closing direction. As a result, the nozzle needle valve 1 moves downward and closes (indicated by C in FIG. 3).

As the nozzle needle valve 1 is closed, the pressure in the fuel passage 4 further increases. If this pressure rise exceeds (as indicated at D in FIG. 3) the opening pressure (which is initially high) which is determined by the pushing force of the spring 3, the force resulting from the pressure of the back pressure chamber 5 and the pressure receiving area of the nozzle needle valve 1, then this needle valve 1 lifts again to reopen the injection.

If the fuel injection is then accomplished a predetermined amount, the flow rate of the fuel pumped to the fuel passage 4 is reduced to drop the pressure of the fuel passage 4. Since, at this time, the passage 11 has its effective area throttled by the diverging portion 34*b*, the pressure in the back pressure chamber 5 drops with a delay from the pressure in the fuel passage. In other words, the pressure in the back pressure chamber 5 is always higher than that in the fuel passage 4. Incidentally, this pressure difference is adjusted by the diverging portion 34*b* for throttling the effective area of the passage 11.

As a result, the closing force of the nozzle needle valve 1, which is determined by the pressure difference and the sectional area of the guide portion of the nozzle needle valve 1, and the biasing force of the spring 3 becomes remarkably strong (high) so that the nozzle needle valve 1 is abruptly closed (indicated by E in FIG. 3).

As the pressure in the fuel passage 4 further drops, the control valve 30 also closes to restore the state shown in FIG. 1. Although some residual pressure is in the back pressure chamber 5 at this time, the fuel passage 4 having a pressure drop receives the fuel from a throttle passage 6 until its pressure restores a low level by the time of a next injection.

Incidentally, the throttle passage 6 always provides communication between the fuel passage 4 and the passage 13 but has its effective area set at a small value so that the inflow of the fuel at the initial stage of the valve opening exerts little influence upon the valve opening.

On the other hand, the throttle passage 6 can naturally be connected not to the fuel passage 4 but to a low-pressure leak passage (not shown). In the first embodiment, moreover, the passage 11 experiences the state, in which its throttling area characteristics are high (as indicated by the curve II of FIG. 2) when the control valve 30 is closed together with the nozzle. If the throttling area is sufficiently large, therefore, the throttle passage 6 can be eliminated.

Some engines do not require the pilot injection. In such case, it is sufficient to suppress the initial injection rate to a low value. The injection valve according to the present embodiment can be used as is in such an engine. In this case, by reducing the effective area of the passage 11 especially before the throttling by the diverging portion 34*b*, for example, the inflow of the fuel into the back pressure chamber 5 can be suppressed to hold the pressure in the back pressure chamber 5 at a low level.

In the case of this structure, the nozzle needle valve 1 is not closed in the course of the injection so that the pilot injection does not occur. Since, however, the nozzle needle valve 1 is forced in the closing direction to hold its lift by the pressure in the back pressure chamber 5, the introduction passage 40 has its effective area reduced. As a result, the injection rate at an early stage can be reduced to gently increase the fuel injection rate.

The valve closes abruptly because the valve closing force is increased by the pressure rise of the back pressure chamber 5.

Incidentally, in this case the pressure in the back pressure chamber 5 when the nozzle valve is to be closed can be equalized to have equivalent valve closing characteristics by setting the effective area of the passage 11 to be throttled by the diverging portion 34*b* at slightly larger value than that of the case of the pilot injection.

Moreover, one engine is enabled to effect the pilot injection at a low engine speed, in which the pumping rate of the fuel per unit time is low, by adjusting the opening pressure of the control valve 30 and the effective area characteristics of the passage 11 by the diverging portion 34*b* and not the pilot injection but merely an injection at a low initial rate at a high engine speed of a high pumping rate by enabling the pressurized fuel to overcome the back pressure which is held at a low level to prevent a temporary valve closing during the injection.

Figure 4:
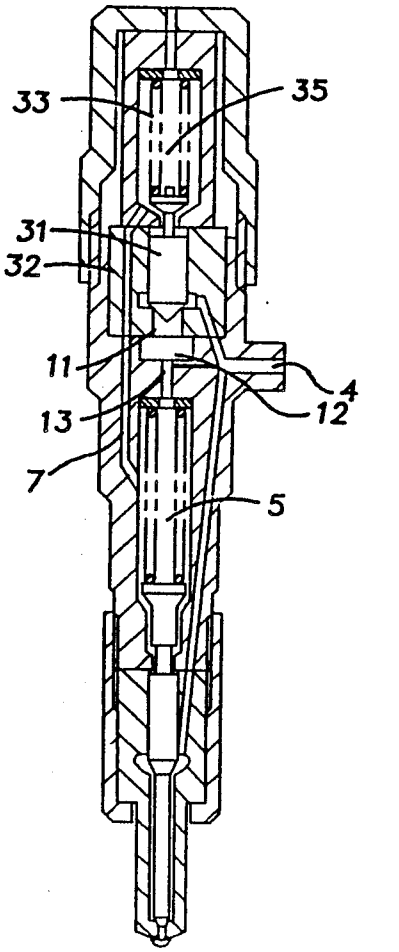
FIG. 4 shows a vertical sectional view of an injector according to a second embodiment of the invention.

FIG. 4 is a sectional view of a second embodiment of the present invention.

In the first embodiment (FIG. 1) the throttle means for throttling the effective area of the passage 11 is formed by the extension 34 formed integrally with the needle valve element 31. However, in the second embodiment (FIG. 4), formed by a second back pressure chamber 35 for communicating with the back pressure chamber 5 via a communication passage 7 and for holding the pressure directed to close the needle valve element 31. The remaining structure is similar to that of the first embodiment.

The operations of the second embodiment (FIG. 4) will now be described. After the nozzle valve has been opened, the needle valve element 31 lifts to open the control valve 30 if the pressure in the fuel passage 4 exceeds the set opening pressure of the control valve 30. As this control valve 30 is opened, the fuel under pressure flows sequentially via the passage 11, the fuel chamber 12 and the passage 13 into the back pressure chamber 5. Since, moreover, the communication passage 7 provides communication between the back pressure chamber 5 and a back pressure chamber 35 for the control valve 30, the fuel of the back pressure chamber 5 flows into the other back pressure chamber 35. As a result, the pressure in the back pressure chamber 35 rises in accordance with the pressure rise of the back pressure chamber 5.

Incidentally, the communication passage 7 may preferably be equipped with a throttle for adjusting the throttling effect thereof so as to make the operations more stable at this time. Here, since the pressure of the back pressure chamber 35 exerts a pressure in the closing direction to the needle valve element 31, this valve 31 moves down to a position in which the difference in the pressures of the fuel upon the upper and lower faces of the needle valve element 31 balances the force of the spring 33. As a result, the passage 11 has its effective area throttled by the leading end portion of the needle valve element 31 so that its area characteristics become apparent the same as those of the first embodiment shown in FIG. 2.

After this, in case the pumping rate of the fuel decreases so that the needle valve element 31 moves downward to close the control valve 30, this control valve 30 is instantly closed with the effective area of the passage 11 being throttled not after the effective area of the passage 11 is once increased as in the first embodiment.

A description of the remaining fundamental operations of the second embodiment are omitted because they are similar to those of the first embodiment.

As described above, the present embodiment can also achieve the injection rate characteristics similar to those of the first embodiment.

In the second embodiment, moreover, the control valve 30 is instantly closed with the effective area of the passage 11 being throttled so that the pressure in the back pressure chamber 5 is held at a high level. As a result, the closing force of the nozzle needle valve 1 is held as it is without any trouble such as the dullness after the injection.

The present invention is not limited to the foregoing two embodiments but can also be applied to a fuel injection valve of the type which is equipped with a piston for operating substantially integrally with a needle valve (as is disclosed in Japanese Patent Publication No. 59-48302, for example). In this disclosure, a pressure chamber for acting upon a piston is used as the back pressure chamber. Moreover, the control valve 30 can be exemplified by an electromagnetic valve for electric control in high accuracy.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A fuel injector for injecting fuel into a combustion chamber of an internal combustion engine comprising:

a nozzle body having a nozzle portion which has an injection port therein for injecting fuel into said combustion chamber, said nozzle body defining a fuel inlet for receiving pressurized fuel;

means for defining a first fuel passage for communicating said nozzle portion with said fuel inlet;

a first needle valve element slidably disposed in said nozzle portion for opening and closing said injection port;

a first spring disposed in said nozzle body for urging said first needle valve element to close said injection port;

a first back pressure chamber means formed in said nozzle body for applying pressure to said first needle valve element;

means for defining a second fuel passage for communication said first back pressure chamber means with said fuel inlet;

an ON-OFF valve means for opening and closing said second fuel passage and for throttling the effective area thereof when said second fuel passage is open thereby controlling the pressure of said back pressure chamber means;

throttle means disposed in a bypass passage bypassing said ON-OFF valve means, and communicating with said back pressure chamber, said throttle means communicating with said fuel inlet.

2. A fuel injector according to claim 1, wherein said ON-OFF valve means includes a second needle valve element for opening and closing said second fuel passage and a second spring for urging said second needle valve element to close said second fuel passage.

3. A fuel injector according to claim 2, wherein said second spring has a spring force that is greater than the spring force of said first spring.

4. A fuel injector according to claim 1, wherein said first spring is housed in said first back pressure chamber means.

5. A fuel injector according to claim 1, further comprising a bypass passage connecting said inlet port with said back pressure chamber and a bypass passage having a restriction therein for relieving at least some of the pressure from said first back pressure chamber after injection of fuel.

6. A fuel injector for injecting fuel into a combustion chamber of internal combustion engine comprising;

a nozzle body having a nozzle portion which has an injection port therein for injecting fuel into said combustion chamber said nozzle body defining a fuel inlet for receiving pressurized fuel;

means for defining a first fuel passage for communicating said nozzle portion with said fuel inlet;

a first needle valve element slidably disposed in said nozzle portion for opening and closing said injection port;

a first spring disposed in said body for urging said first needle valve element to close said injection port;

first back pressure chamber means formed in said nozzle body for applying pressure to said first needle valve element;

means for defining a second fuel passage for communicating said first back pressure chamber means with said fuel inlet;

an ON-OFF valve means including a second needle valve element for opening and closing said second fuel passage, a second spring for urging said second needle valve element to close said second fuel passage and an extension integrated with said second needle valve element for throttling the effective area of said second fuel passage after it has been opened by said second needle valve element thereby controlling the pressure of said first back pressure chamber;

throttle means disposed in a bypass passage bypassing said ON-OFF valve means, and communicating with said back pressure chamber, said throttle means communicating with said fuel inlet.

7. A fuel injector according to claim 6, wherein said extension comprises: a stem portion integrated with a leading end portion of said second valve element and a diverging portion diverging gradually so as to have a larger diameter toward a leading end thereof.

8. A fuel injector for injecting fuel into a combustion chamber of internal combustion engine comprising:

a nozzle body having a nozzle portion which has an injection port therein for injecting fuel into said combustion chamber, said nozzle body defining a fuel inlet for receiving pressurized fuel;

means for defining a first fuel passage for communication said nozzle portion with said fuel inlet;

a first needle valve element slidably disposed in said nozzle portion for opening and closing said injection port;

a first spring disposed in said nozzle body for urging said first needle valve element to close said injection port;

first back pressure chamber means formed in said nozzle body for applying pressure to said first needle valve element;

means for defining a second fuel passage for communication said first back pressure chamber means with said fuel inlet;

an ON-OFF valve means including a second needle valve element for opening and closing said second fuel passage, a second spring for urging said second needle valve element to close said second fuel passage and second back pressure chamber means communicated with said first back pressure chamber for applying pressure to said second valve element and throttling the effective area of said second fuel passage thereby controlling the pressure of said first back pressure chamber means; and throttle means disposed in a bypass passage bypassing said ON-OFF valve means, and communicating with said first back pressure chamber, said throttle means communicating with said fuel inlet.

* * * * *